US005117735A

United States Patent [19]

Flashkes

[11] Patent Number: 5,117,735

[45] Date of Patent: Jun. 2, 1992

[54] MACHINE GUN WITH BELT AND MAGAZINE FEED

[75] Inventor: Adi Flashkes, Ramat-Hasharon, Israel

[73] Assignee: The State of Israel Ministry of Defence Israel Military Industries, Ramat-Hasharon, Israel

[21] Appl. No.: 596,331

[22] Filed: Oct. 12, 1990

[30] Foreign Application Priority Data

Oct. 18, 1989 [IL] Israel ..... 92040

[51] Int. Cl.[5] ..... F41A 9/25; F41A 9/29

[52] U.S. Cl. ..... 59/33.14; 89/33.2; 89/191.01; 89/155; 89/188

[58] Field of Search ..... 89/33.01, 33.14, 33.2, 89/33.1, 191.01, 185, 197, 195, 196, 188

[56] References Cited

U.S. PATENT DOCUMENTS

| | | | |
|---|---|---|---|
| 1,377,629 | 5/1921 | Rosebush | 89/196 |
| 3,060,810 | 10/1962 | Hillberg | 89/196 |
| 3,198,076 | 8/1965 | Stoner | 89/33.01 |
| 3,386,336 | 6/1968 | Roy | 89/33.2 |
| 3,756,119 | 9/1973 | Curtis et al. | 89/33.01 |
| 4,112,817 | 9/1978 | Bourlet | 89/33.2 |

FOREIGN PATENT DOCUMENTS

| | | | |
|---|---|---|---|
| 1220710 | 5/1960 | France | 89/197 |

*Primary Examiner*—Stephen Johnson
*Attorney, Agent, or Firm*—Helfgott & Karas

[57] ABSTRACT

A dual feed light machine gun comprises a barrel, a receiver, a cartridge belt feed mechanism assembly provided on top of the receiver, a magazine socket positioned at the bottom side of the receiver and essentially opposite the cartridge belt feed mechanism assembly. The machine gun includes a slide assembly having a slide which is essentially formed of an elongated, horizontal, rectangular frame with an integral bolt housing at the top near the rear end thereof and a gas piston attached at its front end. The bolt housing houses a bolt which has a head portion with upper and lower projections adapted, respectively, to drive a cartridge from either a belt or a magazine into the breech of the gun.

5 Claims, 9 Drawing Sheets

MACHINE GUN WITH BELT AND MAGAZINE FEED

FIELD OF THE INVENTION

The present invention generally concerns light machine guns and particularly dual feed light machine guns that can be fed by either of a cartridge belt and a magazine, to be referred to hereinafter as a dual feed light machine gun.

GLOSSARY

The meaning of some of the terms that will be used in the following description and claims are as follows:

Body—the major part of the gun between the butt and the barrel. The body comprises, inter alia, a receiver and a belt feed mechanism assembly.

Receiver—the central part of the body which houses the slide.

Belt feed mechanism assembly —an assembly mounted on top of the receiver, by means of which a cartridge belt is fed into the machine gun.

Slide—a member reciprocating inside the receiver, which is biased forward by a recoil spring and is driven backwards by the gas pressure, developing during firing which acts on a piston associated therewith or manually by a cocking lever. The slide houses the bolt and the firing pin.

Bolt—a part of the slide which, during the slide's forward movement, pushes a cartridge into the breech and locks it there. The bolt houses the firing pin and has attached thereto an extractor which is adapted to extract an empty cartridge from the barrel after firing.

Open Type Bolt—a bolt in which the firing pin automatically emerges from the front face of the bolt during the forward movement of the slide.

Barrel Extension—a member either integral with or in close proximity to the barrel's rear in which the bolt is locked during firing.

BACKGROUND OF THE INVENTION

The light machine gun is an important infantry firearm. There is a growing demand and tendency to make firearms versatile, i.e. design them for more then one purpose and accordingly it has already been suggested to make dual feed light machine guns that can be fed alternatively by either of a cartridge belt and a magazine.

A light machine gun with such a dual feed is described in IL 51910 corresponding to U.S. Pat. No. 4,112,817. According to that disclosure, the magazine, when used, is inserted essentially from the side, which is a considerable drawback since it renders the light machine gun very inconvenient for carrying and storming.

SUMMARY OF THE INVENTION

In accordance with the present invention there is provided a dual feed light machine gun comprising a barrel with breech, a receiver, a cartridge belt feed mechanism assembly on top of the receiver, a magazine socket and a slide assembly having an open type bolt:

the magazine socket being at the bottom side of the receiver essentially opposite the cartridge belt feed mechanism assembly;

the slide assembly comprising slide being essentially in the form of a rectangular, elongated frame with an integral bolt housing at the top near the rear end thereof and a gas piston attached at its front end; and said bolt having a head portion with upper and lower projections adapted, respectively, to drive a cartridge from a belt or from a magazine into the breech.

The magazine socket is advantageously fitted with cover flaps which seal the opening thereof when it does not hold a magazine. Preferably the cover flaps are of the kind that fold inwardly when inserting a magazine. One or more of the cover flaps may also serve as a magazine catch and/or support.

The bolt is preferably of a kind wherein its head portion comprises projections adapted for engagement with latches at a barrel extension for locking the bolt during firing. In accordance with this preferred embodiment, the bolt is reciprocal within said integral bolt housing between depressed and emerged positions and comprises a bolt guide which is accommodated within a tortuous inner guiding groove of the housing, whereby during its reciprocations the bolt is caused to turn about its axis to lock and unlock. While the bolt is reciprocal, with respect to the slide the firing pin is stationary with respect thereto. When the bolt is fully depressed, the tip of the firing pin emerges from the front face of the bolt's head portion.

For better understanding a specific embodiment of the invention will now be described with reference to the annexed drawings, it being understood that the invention is not limited thereto.

BRIEF DESCRIPTION OF THE DRAWINGS

The specific embodiment of the invention to be described herein is depicted in the annexed drawings in which.

DESCRIPTION OF A SPECIFIC EMBODIMENT

Figure 1:
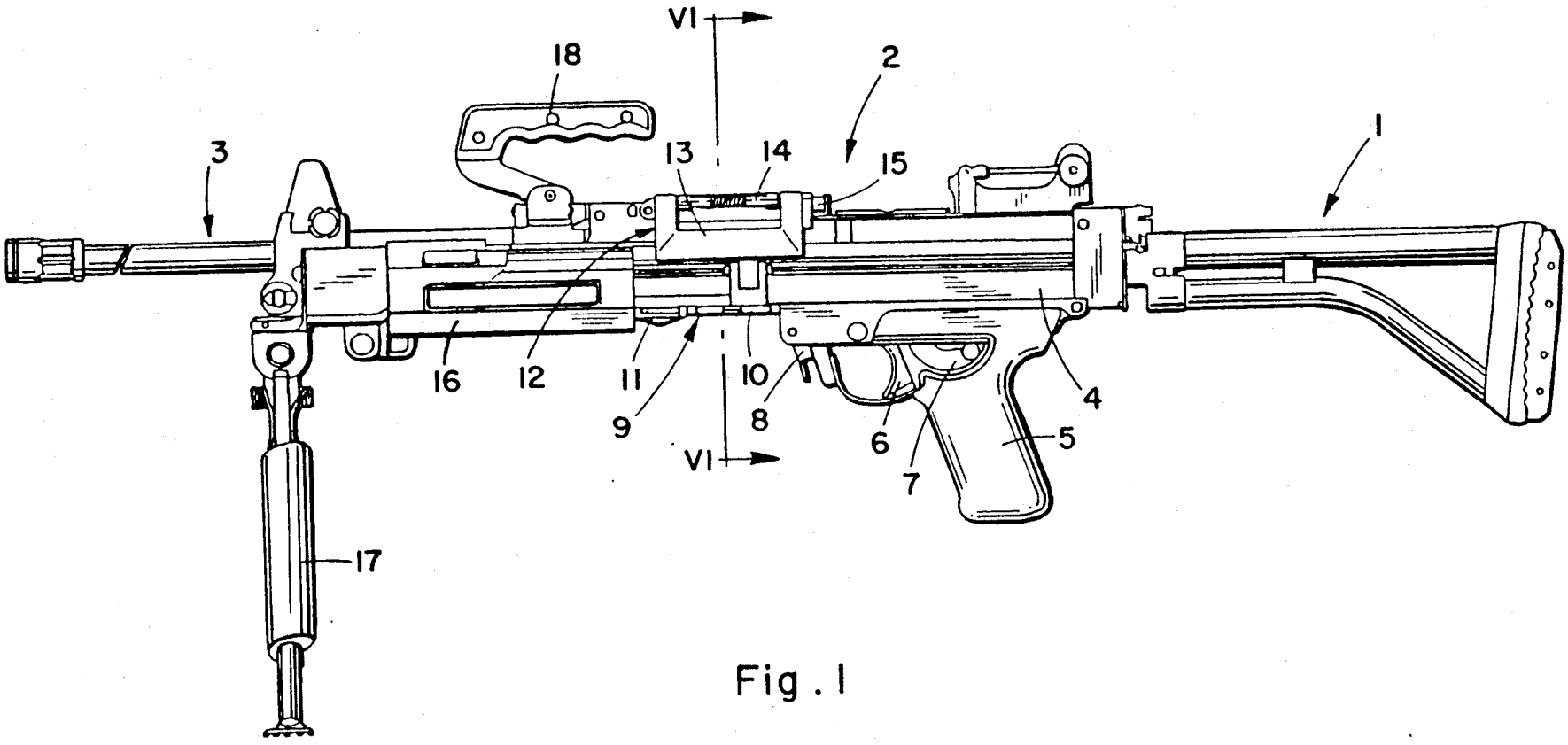
FIG. 1 is a side view of a dual feed light machine gun in accordance with the invention.

The dual feed light machine gun shown in FIG. 1 comprises a foldable stock 1, a body 2 and a barrel assembly 3. Body 2 comprises a receiver 4, a rear grip assembly 5, housing a trigger 6 and a trigger mechanism (not shown), a fire selector 7 and a magazine release lever 8.

In front of the magazine release lever 8 is provider a magazine socket 9, the opening of which is fitted with cover flaps 10 and 10' (cover flap 10' is not shown in FIG. 1) and a further cover flap 10, which are shut when socket 9 does not accommodate magazine. Magazine socket 9 is located at the bottom side of receiver 4 and opposite a belt feed mechanism assembly 12 mounted on the top side at about the central part thereof. Belt feed mechanism assembly 12 comprises a belt feed tray 10 and a receiver cover 14 which latter is locked in the closed state shown in FIG. 1 during firing, but may be released to open by push knob 15.

The receiver is fitted near its fore end with a hand guard 11 and there is also provided a foldable bipod 17 A carrying handle 18 forms part of the barrel assembly 3 and serves both for carrying the gun and for removing the barrel when it has to be replaced.

Slide assembly 31 shown in FIGS. 2 to 5, comprises a slide 32 having the form of a rectangular frame and having on its top near the rear end an integral bolt housing 33 adapted to house a firing pin 34, a spring 35 and a bolt 36. Bolt 36 comprises a head portion 37 fitted with, i.a., an extractor 38 with associated extractor spring 39, both of which are housed inside a cavity 40 and secured in place by means of pins 41 and 42. Firing pin 34 and the associated spring 35 are accommodated within an axial bore 43 of bolt 36.

Figure 2:
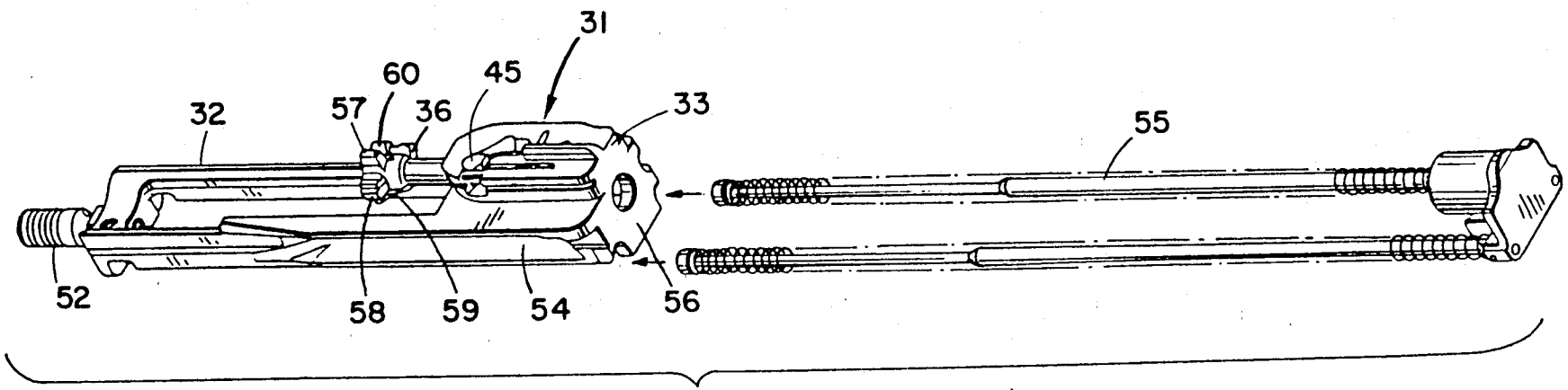
FIG. 2 is a perspective view of the slide assembly of the machine gun of FIG. 1.

The entire bolt assembly is housed within a chamber 44 in the bolt housing 33. Bolt 36 may be inserted into and withdrawn from chamber 44 in the orientation shown in FIG. 3 in which bolt guide 45 is pointing sideways. Once within chamber or axial bore 43, bolt 36 is rotated by about 90° to the orientation shown in FIGS. 2 and 4, in which bolt guide 45 is pointing upwards and is accommodated within tortuous guiding groove 46 in the upper wall of chamber 44. Bolt 36 reciprocates within chamber 43 during which it is guided by bolt guide 45 to turn about its axis. Thus, when the bolt is fully emerging, as shown in FIG. 2, bolt guide 45 points upwards and when it is depressed, as shown in FIG. 4, bolt guide points about 45° clockwise. Bolt 36 is guarded against accidental release by a bolt catch 47 which is housed inside groove 48 and secured in its place by means of pin 49. Bolt 36 is biased forward to the position shown in FIG. 2 by spring 35.

As distinct from the reciprocating bolt 36, firing pin 34 is stationary with respect to the slide and is secured by means of a pin 50 in a position in which its rear block 51 abuts the rear wall of chamber 44.

A gas piston 52 is attached to the front end of the slide and is secured in place by means of pin 53. When the slide is in its fully advanced position, piston 52 is accommodated in a gas cylinder of the barrel assembly (not shown), as known per se.

Figure 3:
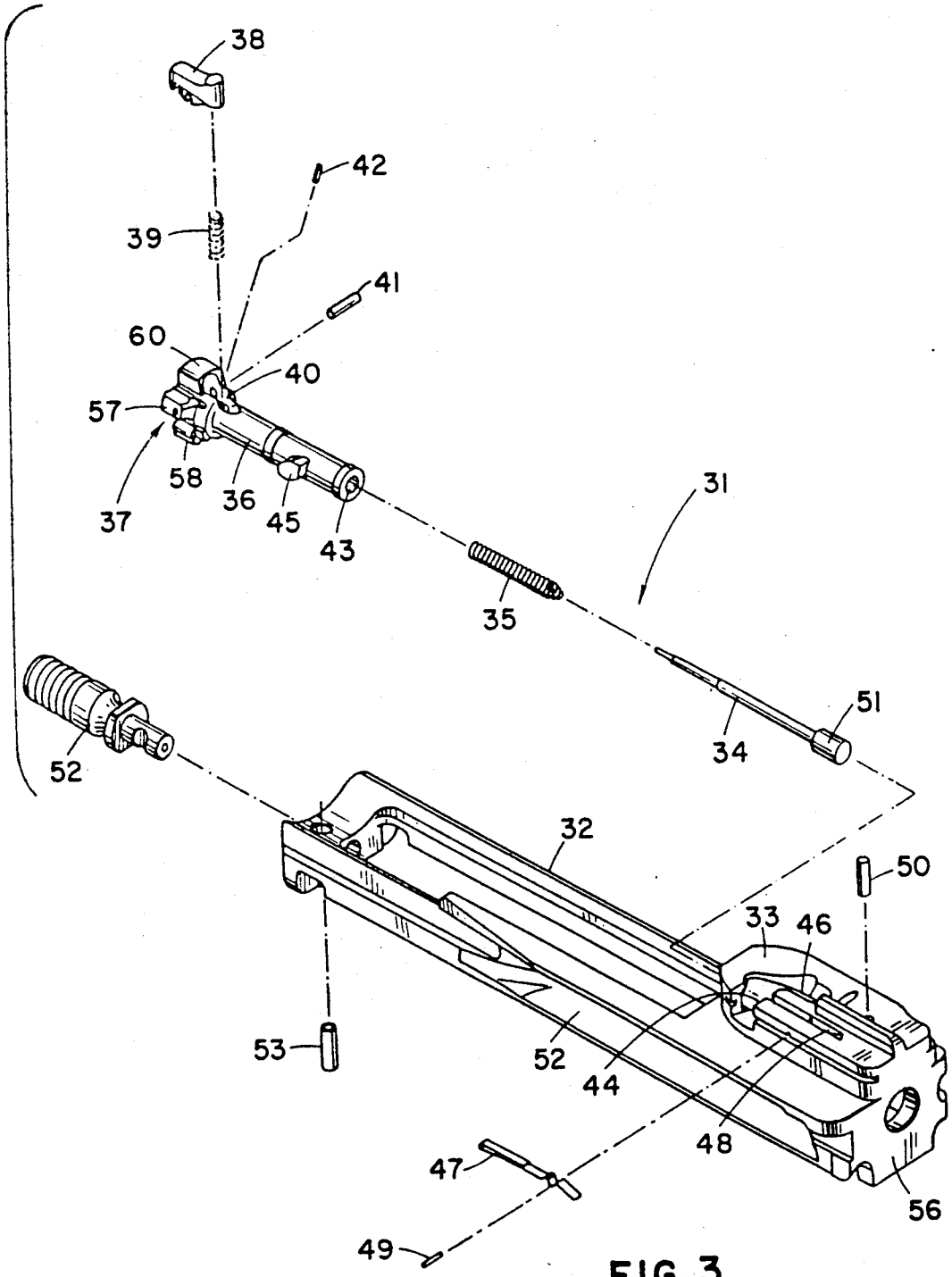
FIG. 3 shows the slide assembly of FIG. 2 in an exploded view.
Figure 4:
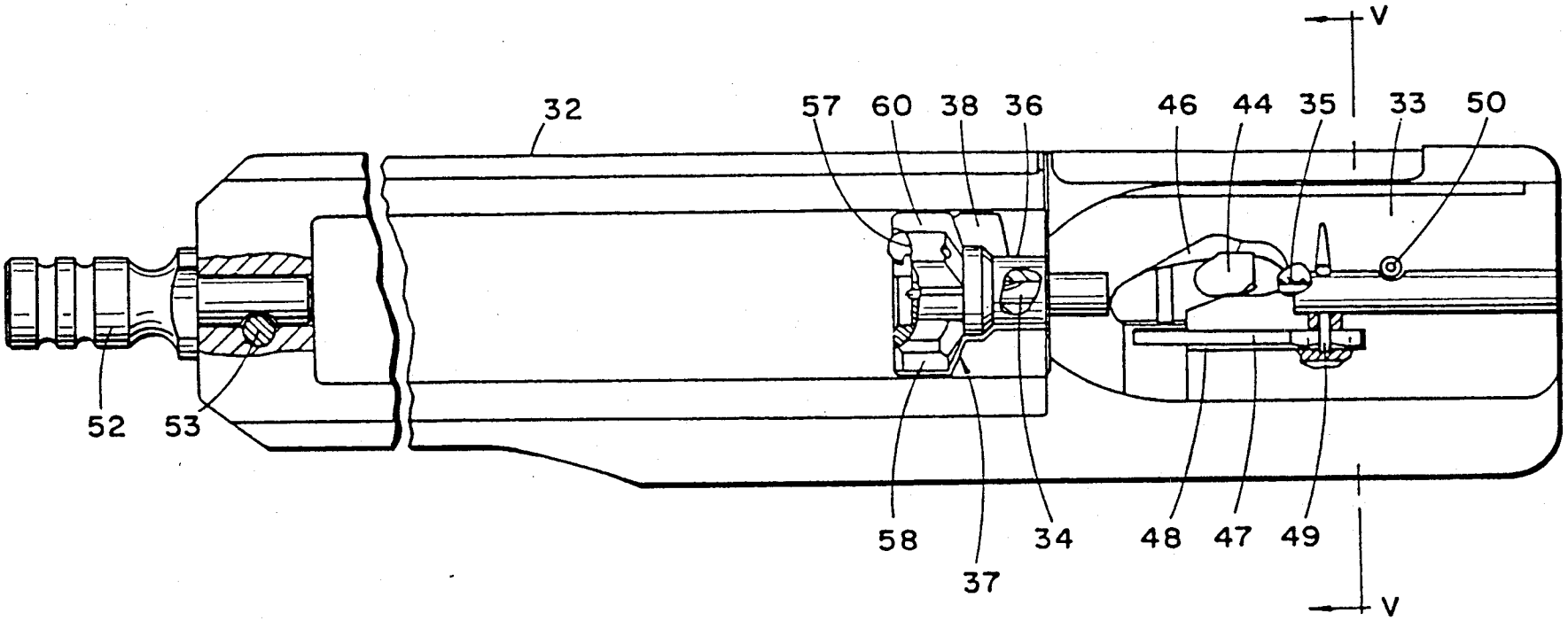
FIG. 4 shows the slide assembly of FIG. 2 when viewed from above.
Figure 5:
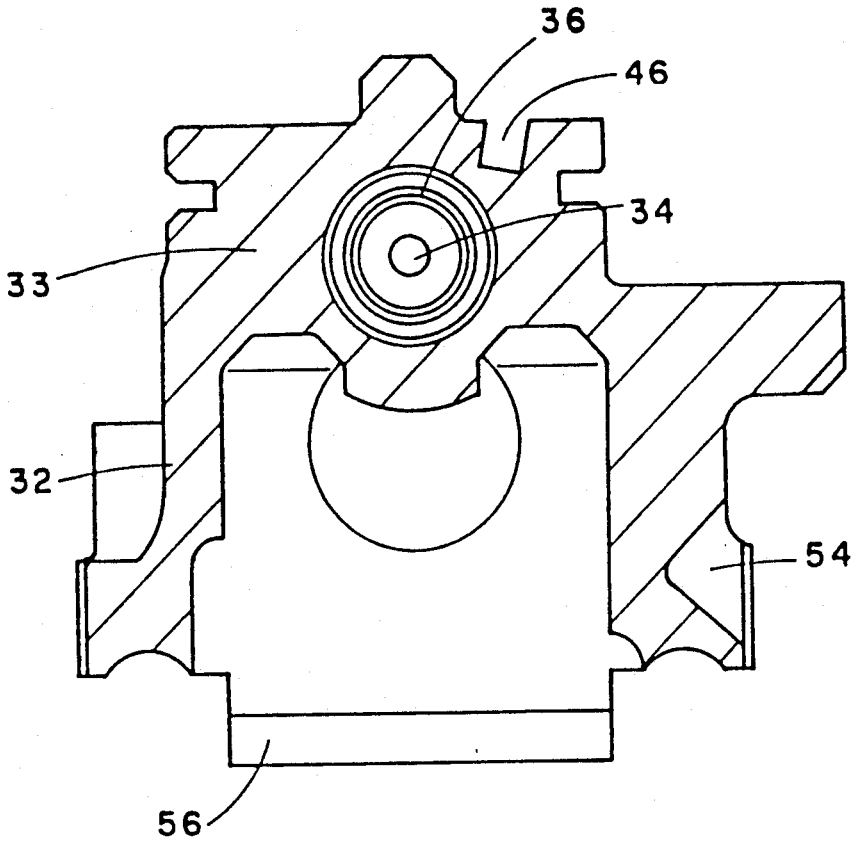
FIG. 5 shows a cross-section along lines V—V of FIG. 4.
Figure 6:
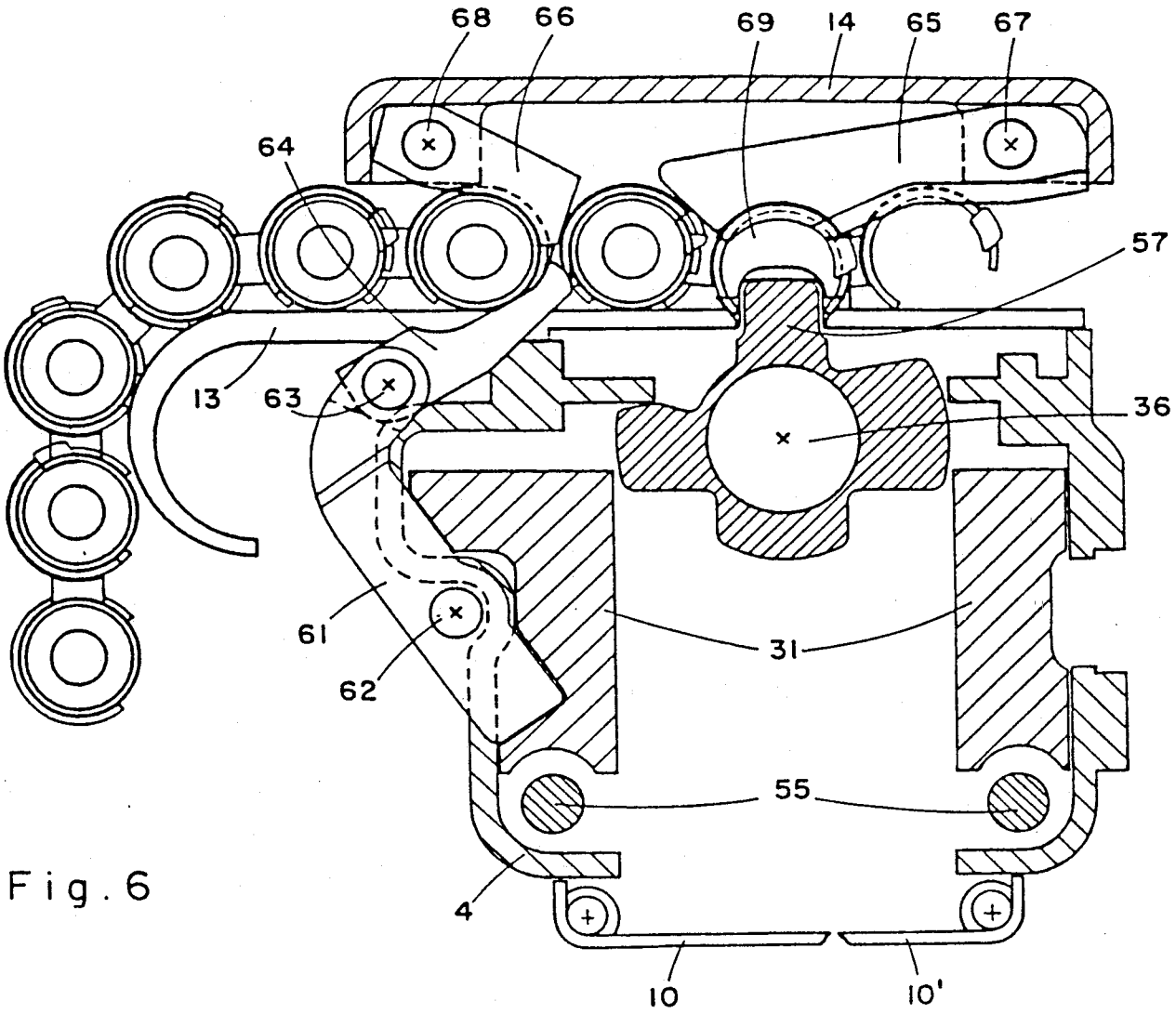
FIG. 6 shows a cross-section along lines VI—VI in FIG. 1, when belt feeding the machine gun.
Figure 8:
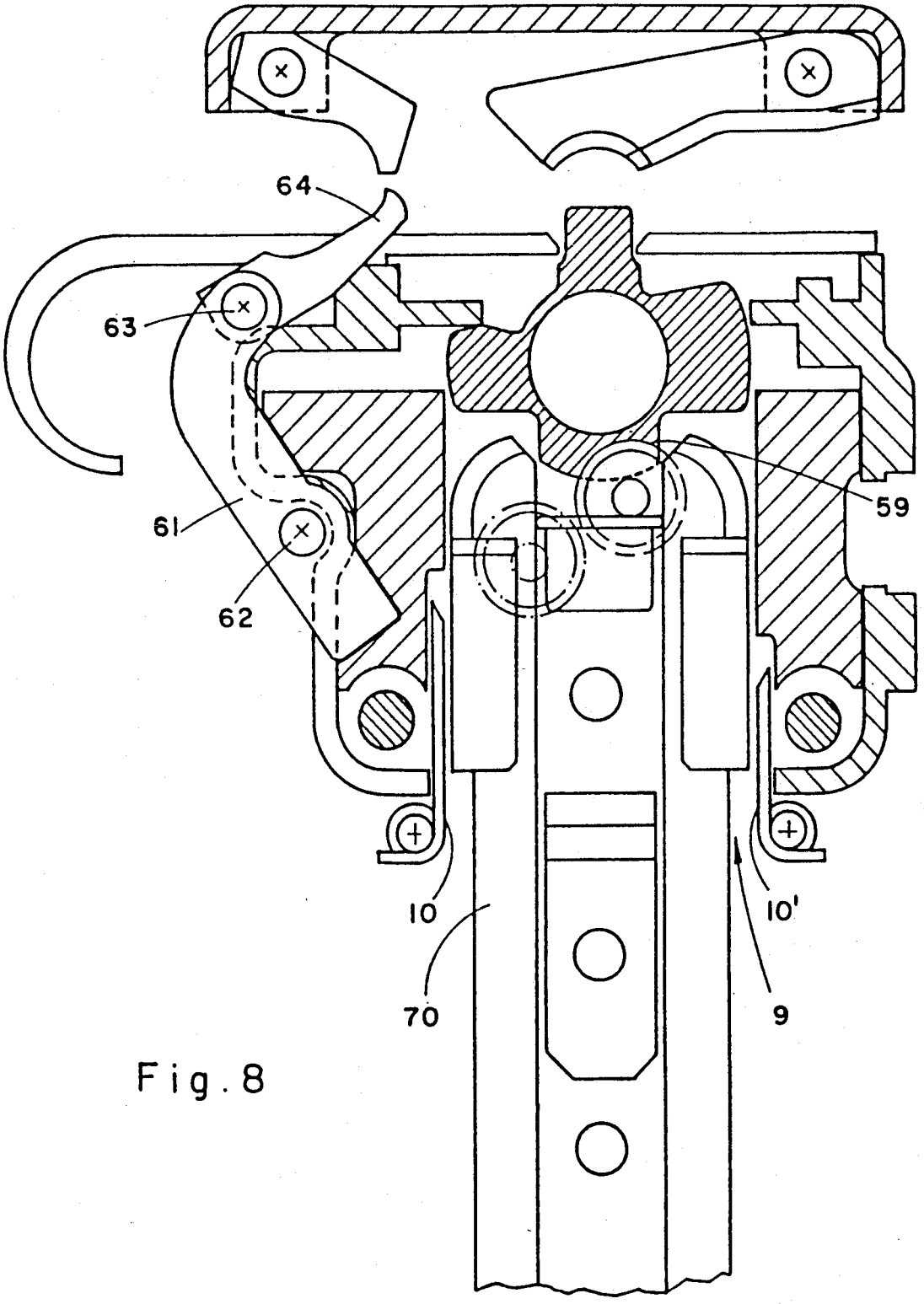
FIG. 8 shows the same cross-section, when magazine feeding the machine.

On its left, slide 32 has an elongated groove 54, which may be seen in FIGS. 2, 3 and 5, adapted for engagement by the lower part of a cartridge's feeding lever 61 (see FIGS. 6 and 8). Groove 54 extends only on the latter portion of the slide's length and due to this change in geometry, along the length of slide 32, lever 61 is caused to swing back and forth during the slide's axial reciprocations inside the receiver 4. As will be further explained below, these swinging movements of actuate feeding pawls, by which the cartridge belt is successively advanced into the receiver during firing.

In operation, which is essentially known per se, slide assembly 31 reciprocates inside the receiver. It is biased forward by means of a recoil spring assembly 55 and is driven backwards by means of either automatically by the gas pressure developing in said gas tube and acting on piston 52 or by means of a manually operated cocking lever (not shown). When cocked, the slide is retained in a retracted position by the engagement of shoulder 56 with sears in the trigger assembly (not shown and all known per se).

Head portion 37 of bolt 36 has an upper projection 57, a left projection 58, a lower projection 59 and a right projection 60 (FIG. 2). These projections are adapted to cooperate with latches of a barrel extension (not shown), so as to lock the bolt at the rear end of the barrel during firing.

In addition to their locking function, in accordance with the invention the upper projection 57 and the lower projection 59 serve during a forward movement of the bolt for driving a cartridge into the rear end of the barrel, from a cartridge belt when the machine gun is belt fed or from a magazine when the machine gun is magazine fed, respectively. In either case a bullet is driven into the barrel by the advancing bolt head 36 of bolt 36, projections 57; 58, 59 and 60 enter the barrel extension until the bolt head 37 hits the rear end of the barrel whereby the advancement of the bolt is abruptly arrested. The slide, however continues to advance whereby bolt guide 45 is forced to follow the tortuous groove which it engages and consequently the bolt turns about 45° clockwise. As a result the projections 57, 58, 59 and 60 of the bolt head 37 engage the latches in the barrel extension whereby the bolt is locked in the barrel extension. Simultaneously, the tip of firing pin 34 emerges from bolt head 37 hitting the bullet's primer.

After firing of a bullet, pressurized gas expands from the barrel into the gas cylinder whereby force develops on the gas piston 52 which pushes the entire slide assembly backwards. This backwards movement causes bolt 36 to turn back by about 45° whereby it is unlocked and may be withdrawn from the barrel extension.

Figure 7:
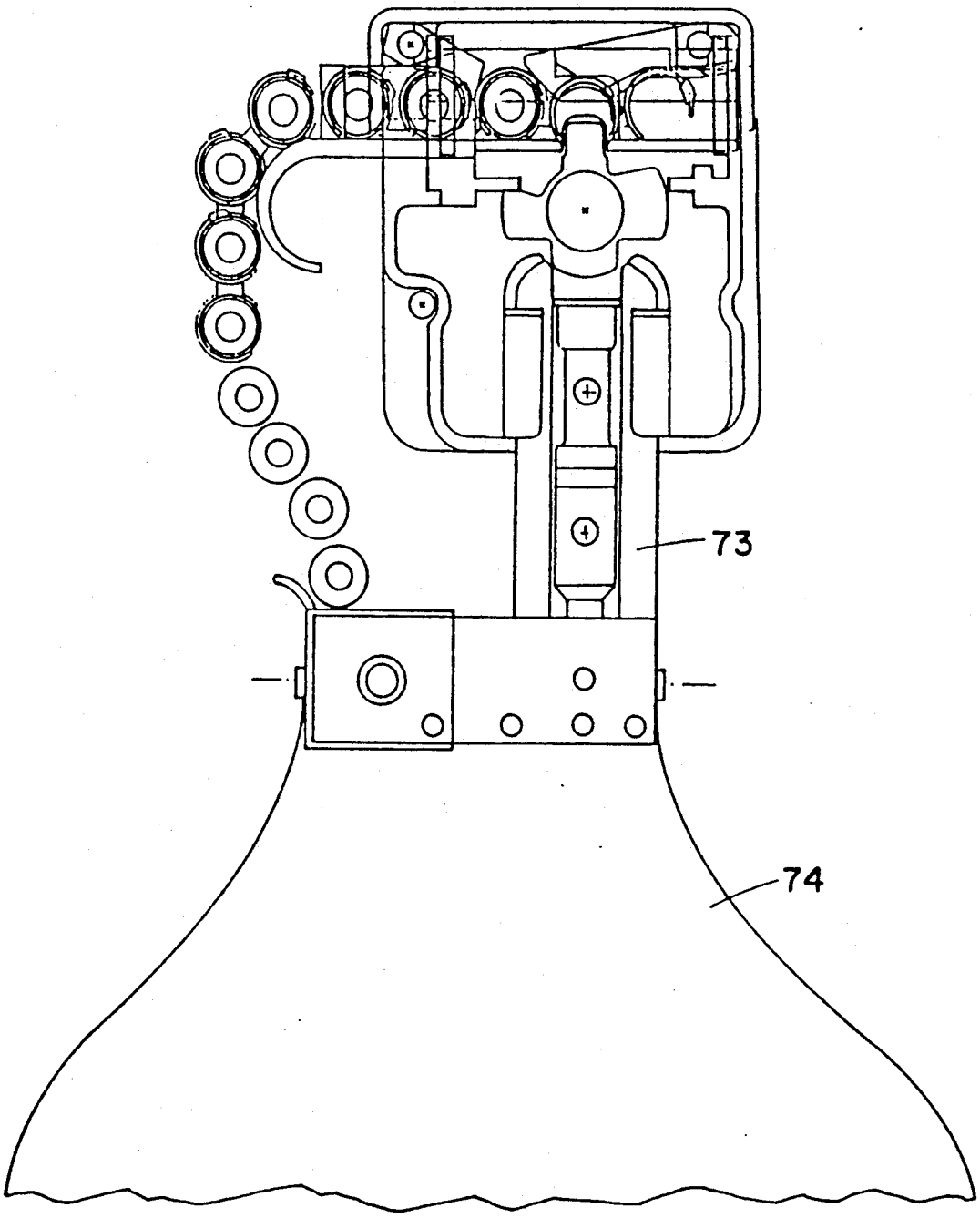
FIG. 7 shows a cross-section similar to that of FIG. 6, drawn to a smaller scale, when belt feeding the machine gun from a belt pouch.
Figure 9:
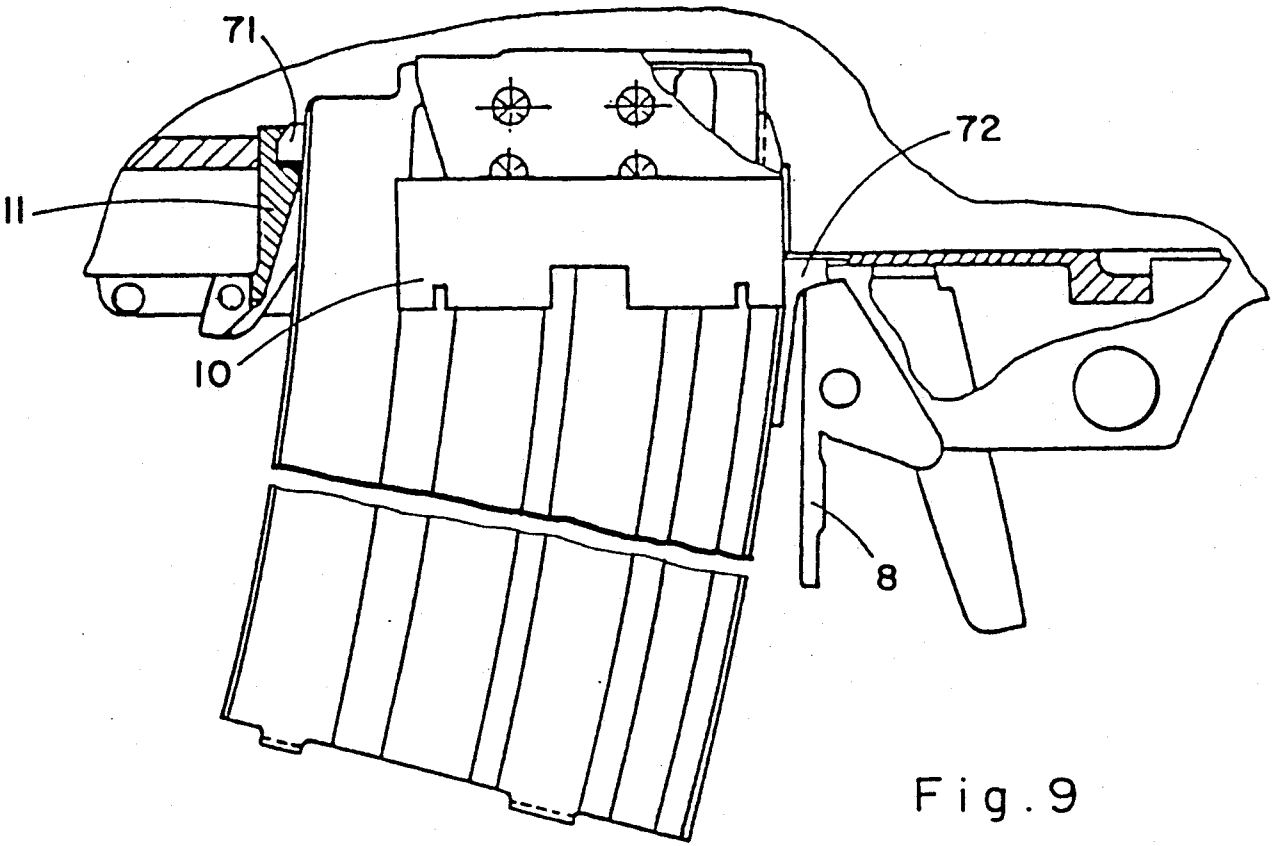
FIG. 9 is a side view, partially in cross-section, showing the magazine socket with an inserted cartridge magazine.

In accordance with the present invention, the gun may be fed with cartridges either from a belt as shown in FIGS. 6 and 7 or from a magazine as shown in FIGS. 8 and 9. Parts which may be identified in these figures are the receiver cover 14, feeding tray 13, receiver 4 which houses the slide assembly 31 bolt 36 recoil spring assembly 55 and magazine socket cover flaps 10, 10' and 11. Further identifiable is feeding lever 61 which is pivotally linked to the housing by pivot 62 and further linked at its top by means of pivot 63 to a pair of feeding pawls 64, (only one of which is shown) which are biased upwards by means of a helical spring (not shown).

A pair of cartridge pawls 65 and a pair of belt retaining pawls 66 (only one of each pair is shown) are linked to the receiver cover 14 by pivots 67 and 68, respectively.

The lower part of the feeding lever 61 engages guiding groove 54 of slide 32 and when the slide reciprocates, the upper part of the lever swings back and forth and causes feeding pawl 64 to reciprocate laterally thereby advancing the cartridge belt successively to the center of the feeding tray. Once a cartridge is at the center of the feeding tray 13 it is pushed by projection 57 of bolt head 37 into the barrel.

During operation, cartridge pawls 65, each of which is biased downwards by a spring (not shown) push a centered cartridge 39 downwards and belt retaining pawls 36, which are equally biased downwards by a spring (also not shown), retain the belt so that it does not slide back during the back swing of feed lever 61.

The framelike structure of slide 31 and the fact that the bolt 36 is housed at the top of the slide, enables the insertion from below of a magazine 70 of the type used in the sub machine guns such as the GALIL (trade name) as shown in FIGS. 8 and 9. When magazine 70 is in socket 9 socket cover flaps 10 and 10' are now inwardly folded and aid in holding the magazine in place. It may be seen in FIG. that the bullets are now driven into the barrel by projection 59.

As shown in FIG. 9, magazine socket cover flap 11 serves also as a magazine catch by engagement with upper projection 71 at the fore wall of the magazine. The aft wall of the magazine has another projection 72 which is engaged by release lever 8 which, when pressed, releases the magazine.

As shown in FIG. 7, the magazine socket is suitable also for the attachment of a belt pouch comprising a magazine dummy 74. Such a pouch stores much more cartridges than a magazine and is useful for use, particularly during storming but also when using the gun as a stationary firing base.

It should be clear to the ma of the art that the above described embodiment is an example only, and various modifications thereof all being within the scope of the invention as defined in the claims are possible.

I claim:

1. A dual feed light machine gun comprising a barrel with a breech, a receiver, a cartridge belt feed mechanism positioned on top of the receiver, a magazine socket, and a slide assembly having an open type bolt, the magazine socket being positioned at the bottom side of the receiver essentially opposite the cartridge belt feed mechanism;

the slide assembly being positioned in said receiver nd comprising a slide arranged for reciprocating movement inside said receiver, said slide being formed as a substantially horizontal, rectangular, elongated frame having an axis of elongation thereof extending in the direction of movement of the slide, said frame including a bolt housing formed at the top near a rear end of said frame integrally therewith for receiving said bolt, and a gas piston attached at a front end of said frame;

said bolt including a head portion having upper and lower projections adapted, respectively to drive a cartridge from a belt or from a magazine into the breech.

2. A dual feed light machine gun according to claim 1, further comprising cover flaps, said magazine socket being fited with said cover flaps.

3. A dual feed light machine gun according to claim 2, wherein at lest one of said cover flaps serves as a magazine catch.

4. A dual feed light machine gun according to claim 2, wherein at least one of said cover flaps serves as a magazine support.

5. A dual feed light machine gun according to claim 1, wherein said bolt is reciprocal within said bolt housing between depressed and emerged positions and includes a bolt guide which is accommodated within a tortuous inner guiding groove formed in said bolt housing whereby, during reciprocations of the bolt the latter is caused to turn about an axis thereof to lock in and unlock from said bolt housing, said head portion of the bolt including projections adapted for engagement with latches at a barrel extension for locking the bolt during firing.

* * * * *

UNITED STATES PATENT AND TRADEMARK OFFICE

CERTIFICATE OF CORRECTION

PATENT NO. : 5,117,735

DATED : June 2, 1992

INVENTOR(S) : ADI FLASHKES

It is certified that error appears in the above-identified patent and that said Letters Patent is hereby corrected as shown below:

On the Title page, change the Assignee to read as follows:

-- [73] Assignee: Israel Military Industries, Ltd.
Ramat-Hasharon 4700, Israel --

Signed and Sealed this

Seventeenth Day of August, 1993

Bruce Lehman

*Attest:*

BRUCE LEHMAN

*Attesting Officer*

*Commissioner of Patents and Trademarks*